US009168193B1

(12) United States Patent
Simi

(10) Patent No.: US 9,168,193 B1
(45) Date of Patent: Oct. 27, 2015

(54) MULTI-PURPOSE MEDICAL SHOWER CHAIR

(71) Applicant: Victor A. Simi, Medford, OR (US)

(72) Inventor: Victor A. Simi, Medford, OR (US)

( * ) Notice: Subject to any disclaimer, the term of this patent is extended or adjusted under 35 U.S.C. 154(b) by 477 days.

(21) Appl. No.: 13/624,562

(22) Filed: Sep. 21, 2012

(51) Int. Cl.
*A47K 3/02* (2006.01)
*A61G 7/10* (2006.01)

(52) U.S. Cl.
CPC ..... *A61G 7/1003* (2013.01); *A61G 7/1005* (2013.01)

(58) Field of Classification Search
CPC ..... A61G 7/1003; A61G 7/1005
USPC ..... 4/561.1, 562.1, 574.1, 576.1, 578.1, 4/604, 611
See application file for complete search history.

(56) References Cited

U.S. PATENT DOCUMENTS

| | | | | |
|---|---|---|---|---|
| 3,040,335 | A * | 6/1962 | Gellmann | 4/570 |
| 3,169,253 | A | 2/1965 | Segar | |
| 4,150,445 | A | 4/1979 | Bailey | |
| 4,628,550 | A | 12/1986 | Walton | |
| 4,998,305 | A | 3/1991 | Davis | |
| 5,129,112 | A | 7/1992 | Schaffer | |
| 5,226,183 | A * | 7/1993 | Clark | 4/562.1 |
| 5,365,618 | A | 11/1994 | Gilbert | |
| 5,477,574 | A | 12/1995 | Skoe | |
| 5,839,131 | A | 11/1998 | Schaffer | |
| 6,226,809 | B1 | 5/2001 | Davies | |
| 6,334,225 | B1 | 1/2002 | Brinkmann | |
| 2008/0235864 | A1 | 10/2008 | Masciarelli | |

* cited by examiner

*Primary Examiner* — Tuan N Nguyen
(74) *Attorney, Agent, or Firm* — Jerry Haynes Law

(57) ABSTRACT

A multi-purpose medical shower chair, including a chair base, a seat assembly having a seat carried by the chair base, and a shower head assembly where the shower head assembly includes a shower head shaft carried by the chair base, a back massage nozzle carried by the shower head shaft, and a shower head nozzle carried by the shower head shaft.

7 Claims, 17 Drawing Sheets

MULTI-PURPOSE MEDICAL SHOWER CHAIR

FIELD OF THE INVENTION

Illustrative embodiments of the disclosure generally relate to apparatuses and methods for showering or bathing physically challenged persons. More particularly, illustrative embodiments of the disclosure relate to a multi-purpose medical shower chair which facilitates showering, bathing and massaging of physically challenged persons.

BACKGROUND OF THE INVENTION

Persons who are physically challenged because of age, injury, or disease may encounter difficulty in bathing or showering. For example, physically challenged persons may have trouble standing in a shower stall or a bathtub while taking a shower, requiring that the persons grip handrails on the inside of the bathtub or shower if they are available. In order to overcome these drawbacks, various devices have therefore been developed for supporting a person in a sitting position while bathing or showering.

Some conventional solutions to supporting physically challenged persons in a bathtub or shower require permanent conversion of the bathtub or shower in such a manner that entrance of a physically challenged user into the bathtub or shower is facilitated. Such conversions may necessitate major structural change to the bathing or showering facility and/or to the surrounding wall or floor area. Permanent modification of an existing bathing or showering facility may be undesirable from cost and other standpoints. Moreover, many conventional solutions to the problem may not enable a physically challenged user to obtain a fully-body wash or massage.

Accordingly, a multi-purpose medical shower chair which facilitates showering, bathing and massaging of physically challenged persons may be desirable for some applications.

SUMMARY OF THE INVENTION

The disclosure is generally directed to a multi-purpose medical shower chair. An illustrative embodiment of the device includes a chair base, a seat assembly having a seat carried by the chair base, and a shower head assembly. The shower head assembly includes a shower head shaft carried by the chair base, a back massage nozzle carried by the shower head shaft, and a shower head nozzle carried by the shower head shaft.

BRIEF DESCRIPTION OF THE DRAWINGS

Illustrative embodiments of the disclosure will now be described, by way of example, with reference to the accompanying drawings, in which.

DETAILED DESCRIPTION

Figure 1:
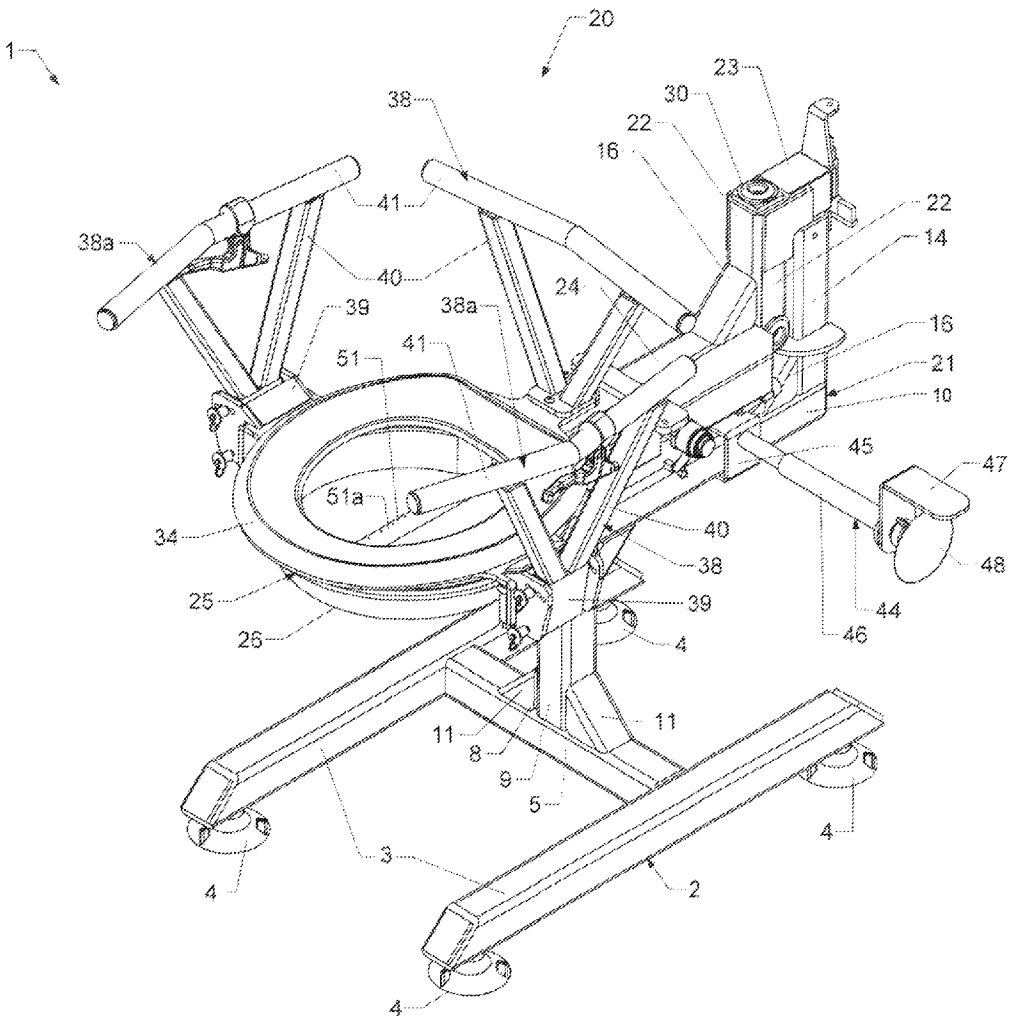
FIG. 1 is a perspective view of an illustrative embodiment of the multi-purpose medical shower chair.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the claims. Moreover, the illustrative embodiments described herein are not exhaustive and embodiments or implementations other than those which are described herein and which fall within the scope of the appended claims are possible. Furthermore, there is no intention to be bound by any expressed or implied theory presented in the preceding technical field, background, brief summary or the following detailed description.

Referring initially to FIGS. 1-4 of the drawings, an illustrative embodiment of the multi-purpose medical shower chair, hereinafter chair, is generally indicated by reference numeral 1. The chair 1 includes a chair base 2. The chair base 2 may include a pair of generally elongated, parallel, spaced-apart base members 3. Each base member 3 may be fitted with a pair of spaced-apart feet 4 which are adapted to support the chair base 2 on a floor or other support surface (not illustrated). A base member connector 5 may connect the base members 3 to each other, imparting a generally H-shape to the chair base 2. In some embodiments, the base members 3 and the base member connector 5 of the chair base 2 may be square tubing.

Figure 2:
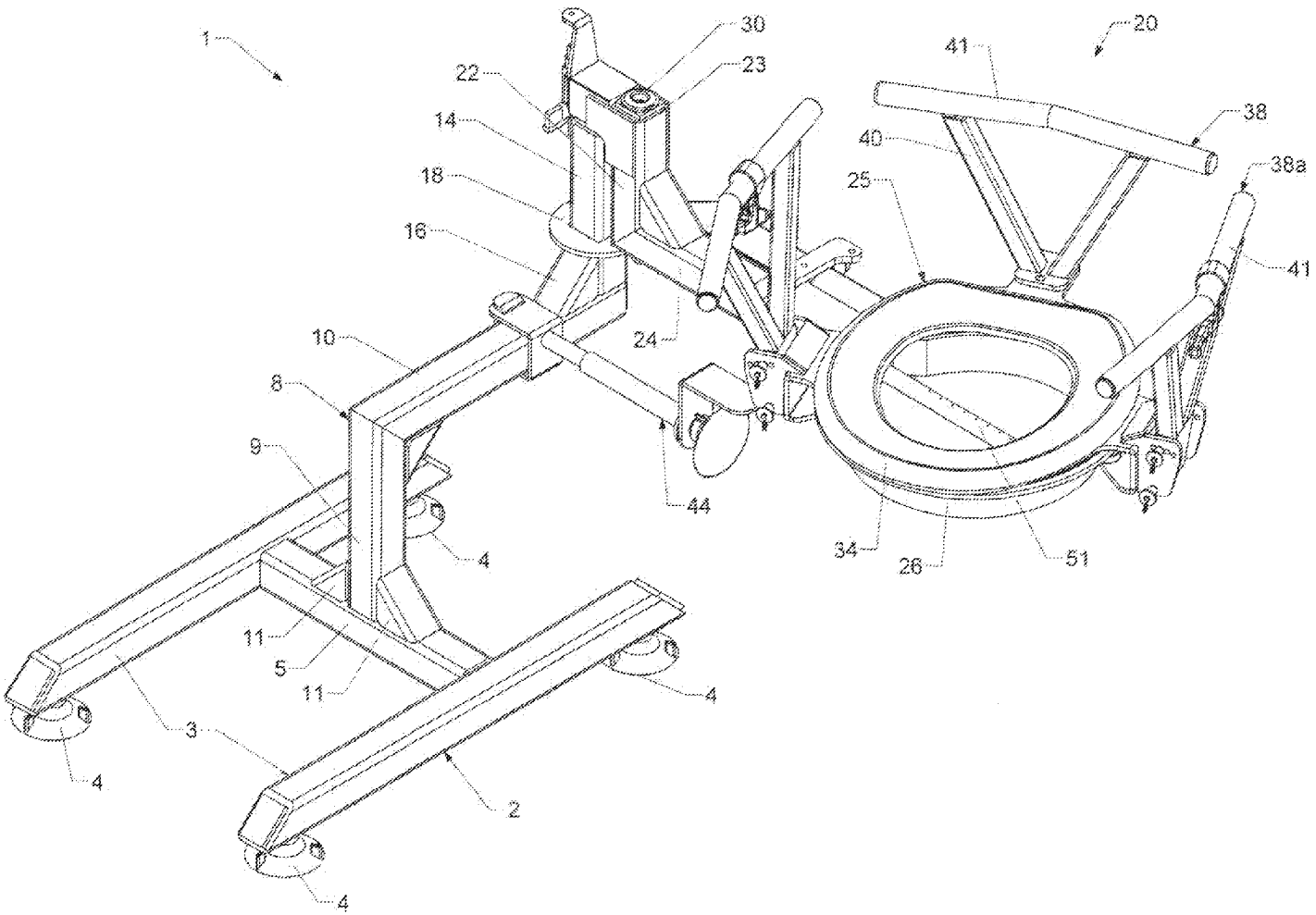
FIG. 2 is a perspective view of the multi-purpose medical shower chair, with a seat assembly of the chair deployed in a side position.
Figure 3:
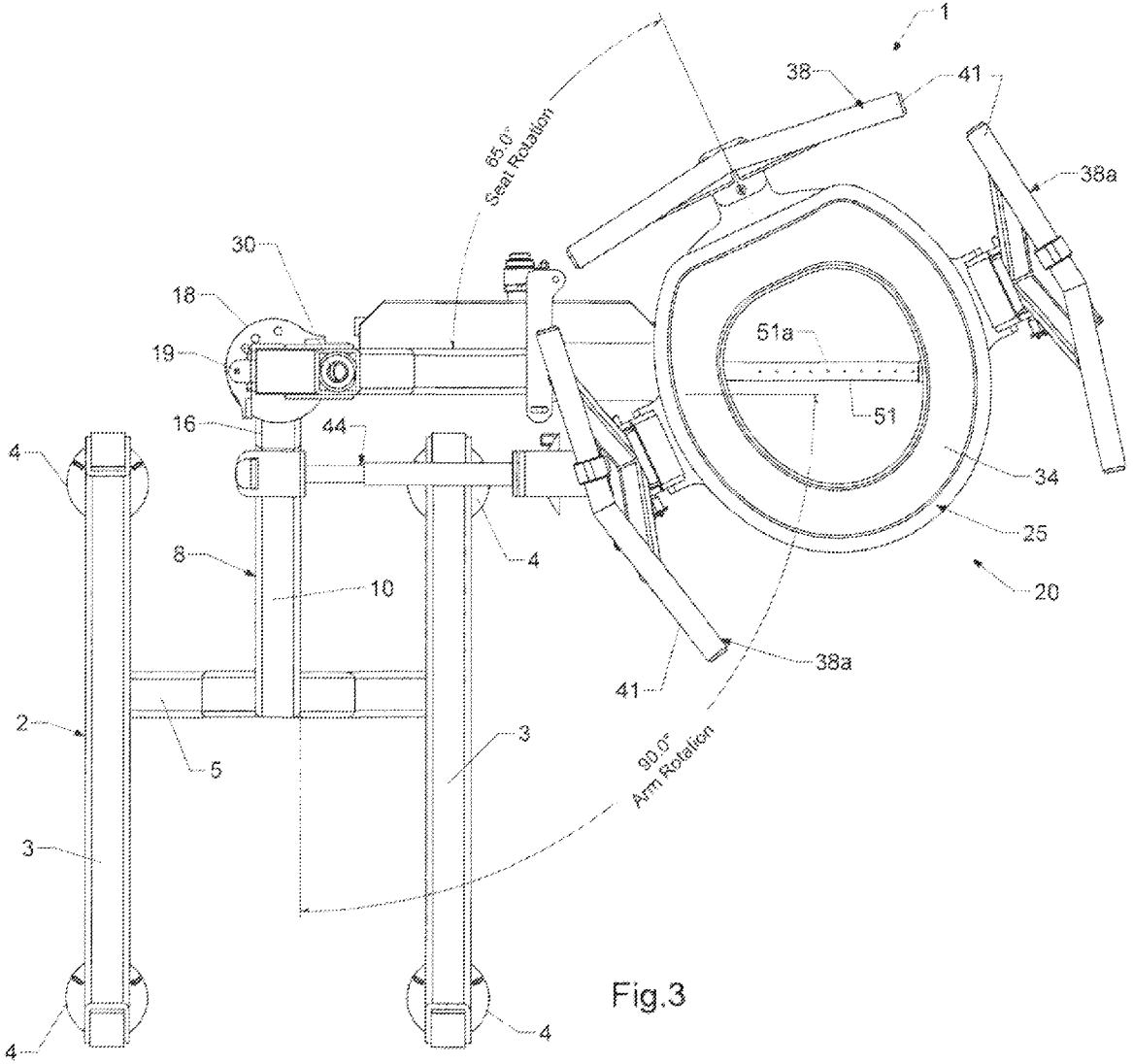
FIG. 3 is a top view of the multi-purpose medical shower chair with the seat assembly of the chair deployed in a side position.
Figure 4:
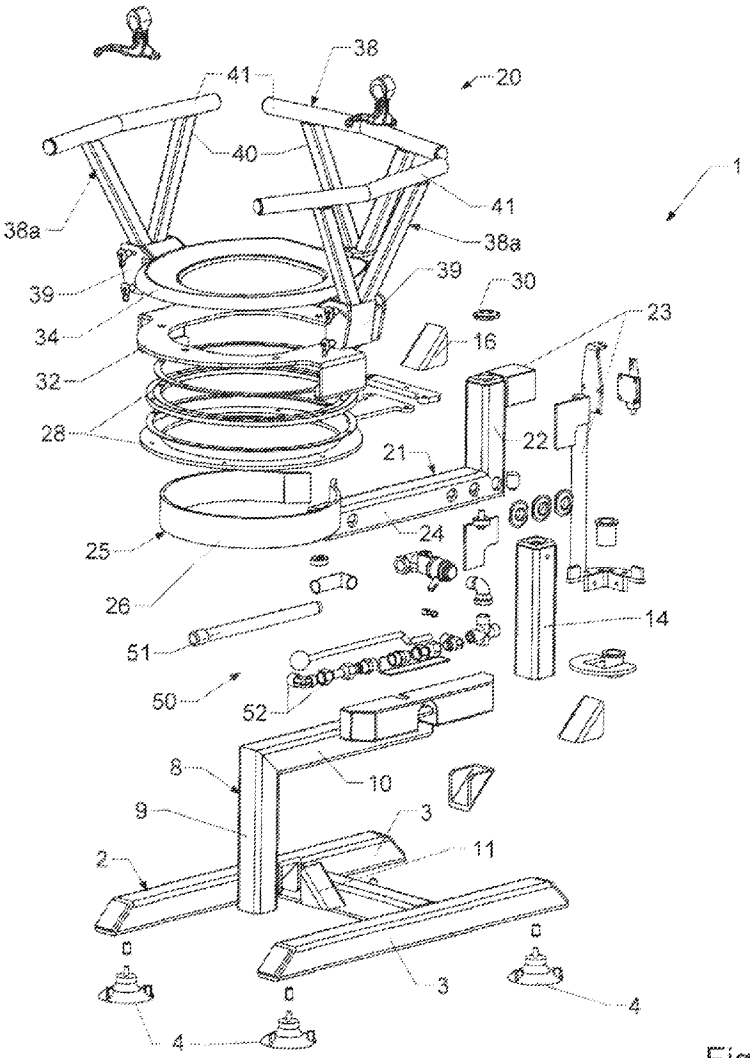
FIG. 4 is an exploded perspective view of the multi-purpose medical shower chair.

As particularly illustrated in FIGS. 2-4, a chair base arm 8 extends from the chair base 2. The chair base arm 8 may include a generally elongated vertical arm segment 9 which extends upwardly from the base member connector 5 of the chair base 2. At least one gusset 11 may reinforce or stabilize the vertical arm segment 9 in the upward-standing or vertical position on the base member connector 5. A generally elongated horizontal arm segment 10 may extend generally perpendicularly and horizontally from the vertical arm segment 9. At least one gusset 11 may similarly reinforce or stabilize the horizontal arm segment 10 in the horizontal position on the vertical arm segment 9. As illustrated in FIGS. 2 and 3, in some embodiments, a longitudinal axis of the vertical arm segment 9 may be disposed in perpendicular relationship to a longitudinal axis of each of the base members 3 of the chair base 2. A longitudinal axis of the horizontal arm segment 10 may be disposed in parallel relationship to a longitudinal axis of each of the base members 3 of the chair base 2 and in perpendicular relationship to the longitudinal axis of the vertical arm segment 9.

A seat assembly mount post 14 is upward-standing from the horizontal arm segment 10 of the chair base arm 8. At least one gusset 16 may stabilize the seat assembly mount post 14 on the horizontal arm segment 10. A seat assembly 20 is supported by the seat assembly mount post 14. As illustrated in FIG. 4, the seat assembly 20 may include a seat support arm 21 which is coupled to the seat assembly mount post 14 such as in a manner which will be hereinafter described. As illustrated in FIG. 4, the seat support arm 21 may be generally L-shaped and may have a vertical support arm segment 22 and a generally elongated horizontal support arm segment 24 which extends from the vertical support arm segment 22. An assembly coupling 23 may couple the vertical support arm segment 22 of the seat support arm 21 to the seat assembly mount post 14. A shaft collar 30 may be provided on the vertical support arm segment 22 of the seat support arm 21 for purposes which will be hereinafter described.

A seat 25 is provided on the horizontal support arm segment 24 of the seat support arm 21. As illustrated in FIG. 4, the seat 25 may include a seat bottom 26. The seat bottom 26 may have a generally annular shape and may be attached to the horizontal support arm segment 24 using fasteners, welding and/or other suitable attachment technique known by those skilled in the art. An annular seat frame 28 may be provided on the seat bottom 26. A seat bottom 32 may be provided on the seat frame 28. A seat top 34 may be provided on the seat bottom 32.

The seat 25 may be fitted with a backrest assembly 38 and at least one handrail assembly 38*a*. The backrest assembly 38 and each handrail assembly 38*a* may include a rail support bracket 39 which may be attached to the seat top 34 or other element of the seat 25. A rail support frame 40 may extend from the rail support bracket 39. An elongated rail 41 may be provided on the rail support frame 40. In some embodiments, a handrail assembly 38*a* may be provided on each side and a backrest assembly 38 on the rear of the seat 25, as illustrated, to stabilize a user (not illustrated) as the user sits on the seat 25 in use of the chair 1, as will be hereinafter described.

In some embodiments, a shower tube 51 may be provided beneath or inside the seat 25 of the seat assembly 20. Multiple shower tube openings 51*a* (FIG. 1) may be provided in a selected pattern along the length of the shower tube 51. As illustrated in FIG. 4, the shower tube 51 may be part of a shower tube assembly 50 having shower tube fittings 52 which facilitate attachment of the shower tube 51 to a water source (not illustrated) for purposes which will be hereinafter described. The shower tube fittings 52 of the shower tube assembly 50 may further include at least one flow control valve (not illustrated) which controls flow of water from the water source to the shower tube 51 and upward discharge of the water from the shower tube openings 51*a* into the seat 25.

As illustrated in FIGS. 2 and 3, in some embodiments, the assembly coupling 23 may facilitate selective rotation or pivoting of the vertical support arm segment 22 of the seat support arm 21 relative to the seat assembly mount post 14 in such a manner that the seat assembly 20 is capable of rotation within a horizontal plane, according to the knowledge of those skilled in the art. Accordingly, the seat 25 of the seat assembly 20 can be selectively positioned at a "home" position over the chair base 2, in which the longitudinal axis of the seat support arm 21 is parallel to the longitudinal axis of the chair base 2, as illustrated in FIG. 1, or can alternatively be selectively positioned outwardly to either side of the chair base 2, typically up to 90 degrees relative to the longitudinal axis of the chair base 2, as illustrated in FIGS. 2 and 3.

As illustrated in FIGS. 2 and 3, in some embodiments, a seat position lock plate 18 having multiple lock plate openings (not numbered) may be provided on the seat assembly mount post 14. A seat position lock flange 19 (FIG. 3) having a lock flange opening (not numbered) may be provided on the vertical support arm segment 22 of the seat support arm 21. As the seat support arm 21 is pivoted or rotated relative to the seat assembly mount post 14 between the home position of FIG. 1 and the side position of FIGS. 2 and 3, the lock flange openings in the seat position lock flange 19 successively register with the lock flange opening in the seat position lock flange 19. Accordingly, a lock pin (not illustrated) can be inserted through one of the plate openings in the seat position lock plate and through the registering lock flange opening in the seat position lock flange 19 to selectively lock the seat assembly 20 in the home position of FIG. 1, the side position of FIGS. 2 and 3, or in any selected position there between.

As illustrated in FIGS. 1-3, in some embodiments, at least one chair stabilizing assembly 44 may be provided on the chair base arm 8 of the chair base 2. The chair stabilizing assembly 44 may facilitate attachment of the chair 1 to a wall (not illustrated) inside a bathtub, shower or other bathing or showering facility, for example and without limitation. Accordingly, the chair stabilizing assembly 44 may include an attachment bracket 45 which is adapted for attachment to the horizontal arm segment 10 of the chair base arm 8 according to the knowledge of those skilled in the art. An elongated attachment arm 46 may extend from the attachment bracket 45. A suction cup bracket 47 may terminate the extending or distal end of the attachment arm 46. The suction cup bracket 47 may be fitted with at least one suction cup 48. Therefore, the suction cup 48 can be attached to the wall of the bathing or showering facility to stabilize the chair 1 in the facility during use of the chair 1, as will be hereinafter described.

Figure 5:
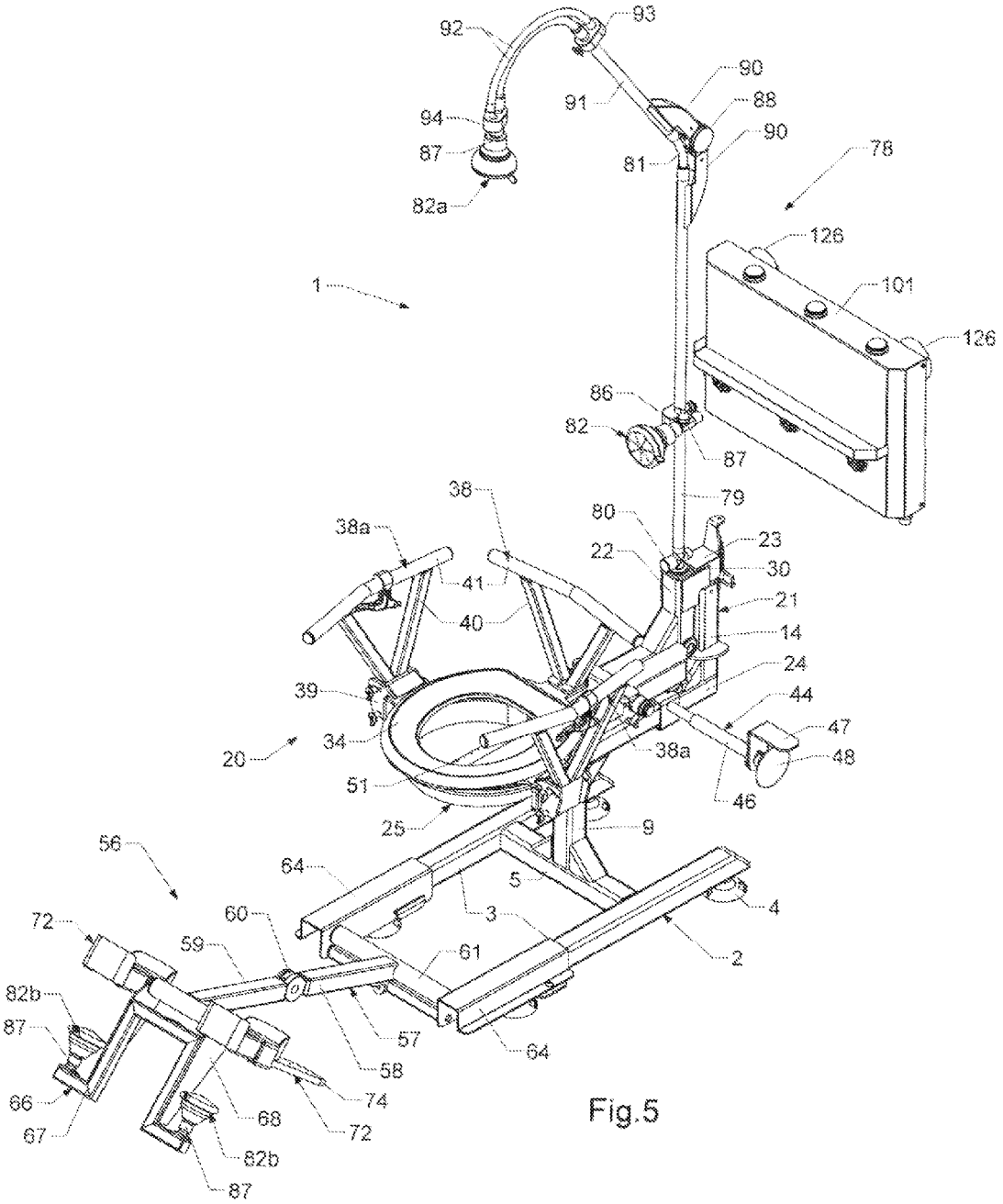
FIG. 5 is a perspective view of the multi-purpose medical shower chair, with a foot massage assembly and a shower head assembly fitted on the multi-purpose medical shower chair.
Figure 6:
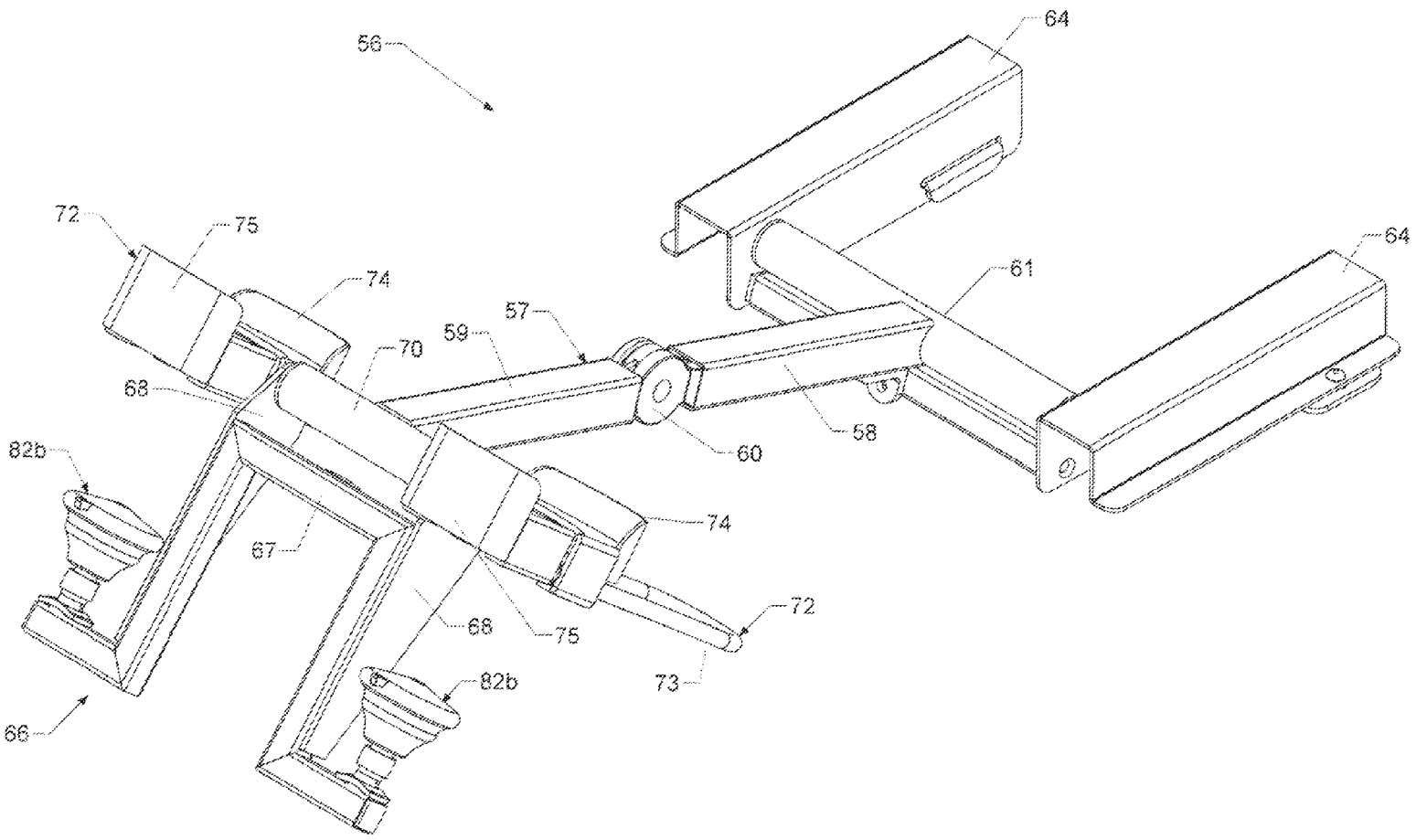
FIG. 6 is a perspective view of an exemplary foot massage assembly.

Referring next to FIGS. 5-15 of the drawings, in some applications, the chair 1 may be used in conjunction with a foot massage assembly 56 which facilitates water massaging of the feet of a user (not illustrated) as the user sits in the chair 1. The foot massage assembly 56 may include at least one assembly mount bracket 64. Each assembly mount bracket 64 may be generally elongated and have a generally channel-shaped cross-section to receive a corresponding one of the base members 3 of the chair base 2, as illustrated in FIG. 5. A foot massage assembly frame 57 may be pivotally attached to the assembly mount brackets 64. The foot massage assembly frame 57 may include an elongated bracket arm 61 which extends between and is pivotally attached to the assembly mount brackets 64. A proximal frame arm 58 may extend from the bracket arm 61. A distal frame arm 59 may be pivotally attached to the proximal frame arm 58 at an arm hinge 60.

A foot support 66 is provided on the distal frame arm 59 of the foot massage assembly frame 57. The foot support 66 may include a stirrup connector 70 which terminates the distal frame arm 59 of the foot massage assembly frame 57. A pair of spaced-apart foot stirrups 72 are provided on the stirrup connector 70. Each foot stirrup 72 may include a generally elongated U-shaped stirrup frame 73 which may be pivotally attached to a corresponding end of the stirrup connector 70. A heel support 74 may be provided on the stirrup frame 73. A toe support 75 may be provided on the stirrup frame 73 adjacent to the heel support 74. The toe support 75 may be slidably positional with respect to the heel support 74 on the stirrup frame 73 to accommodate a particularly-sized foot (not illustrated) of a user as the user sits on the seat 25 of the seat assembly 20.

Figure 7:
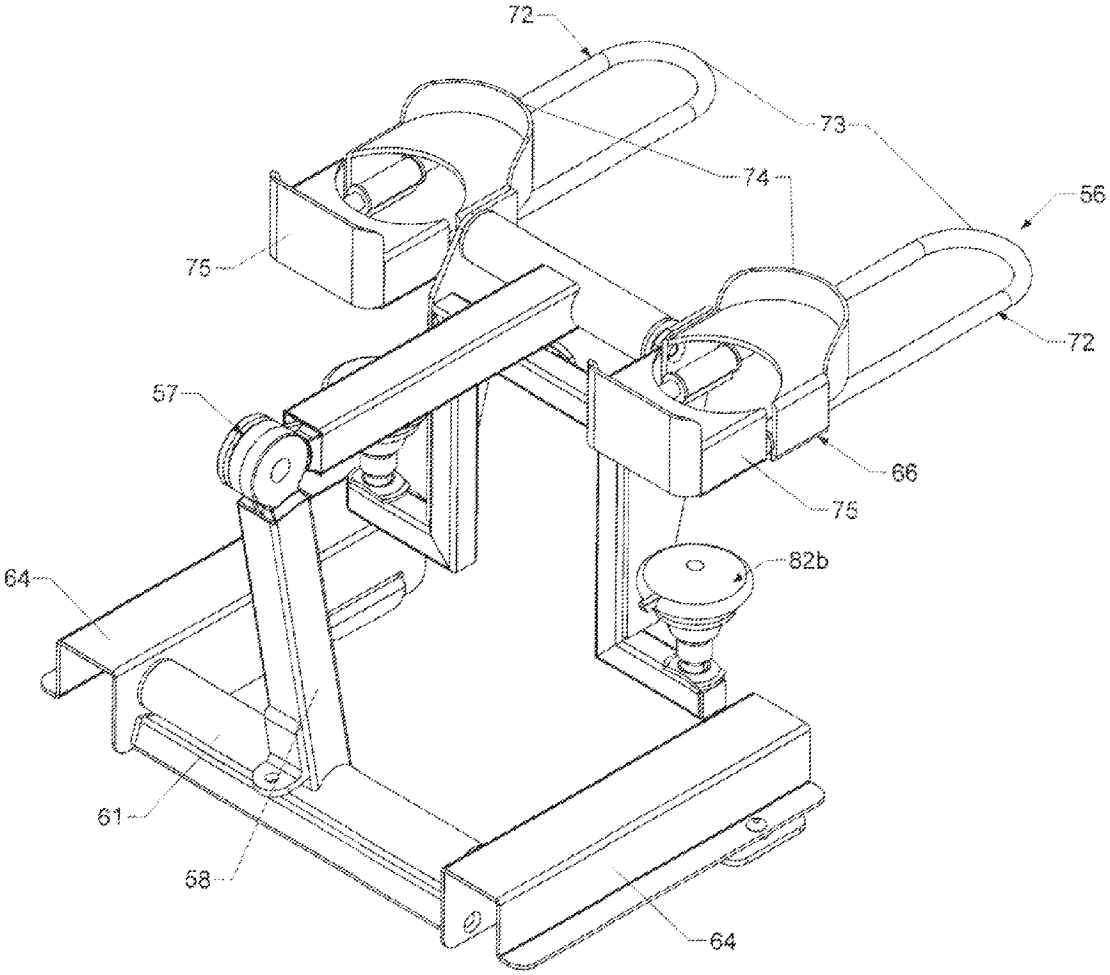
FIG. 7 is a perspective view of the foot massage assembly deployed in a folded position.
Figure 8:
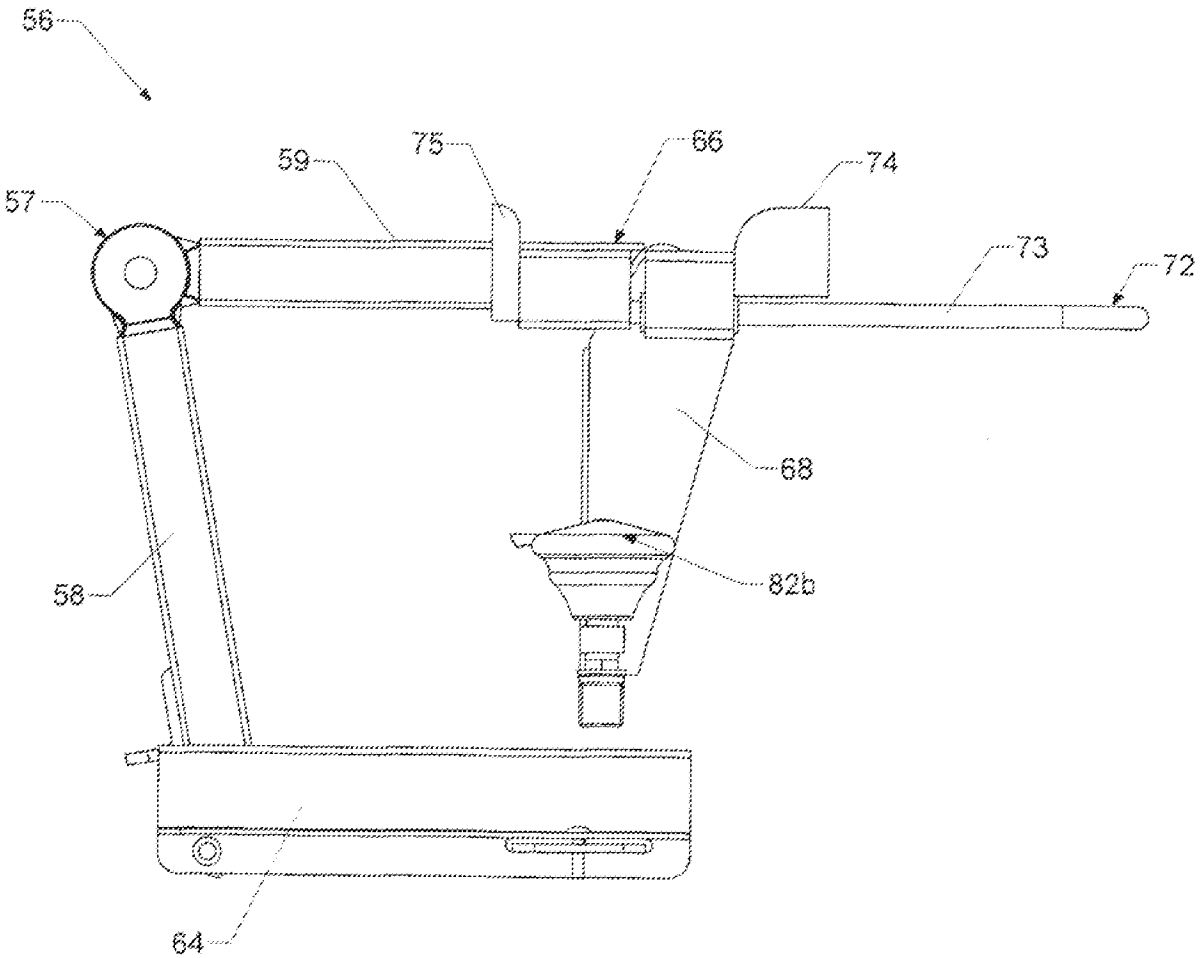
FIG. 8 is a side view of the foot massage assembly deployed in the folded position.
Figure 9:
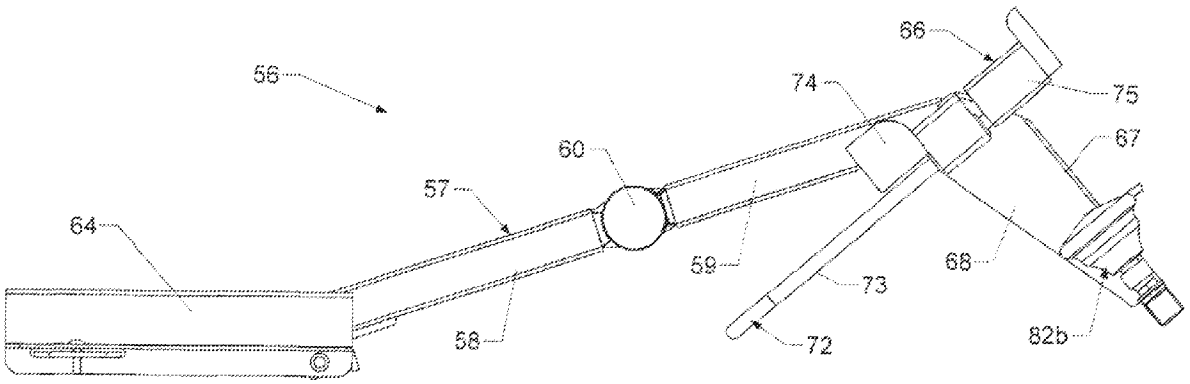
FIG. 9 is a right side view of the foot massage assembly deployed in a straight position.
Figure 10:
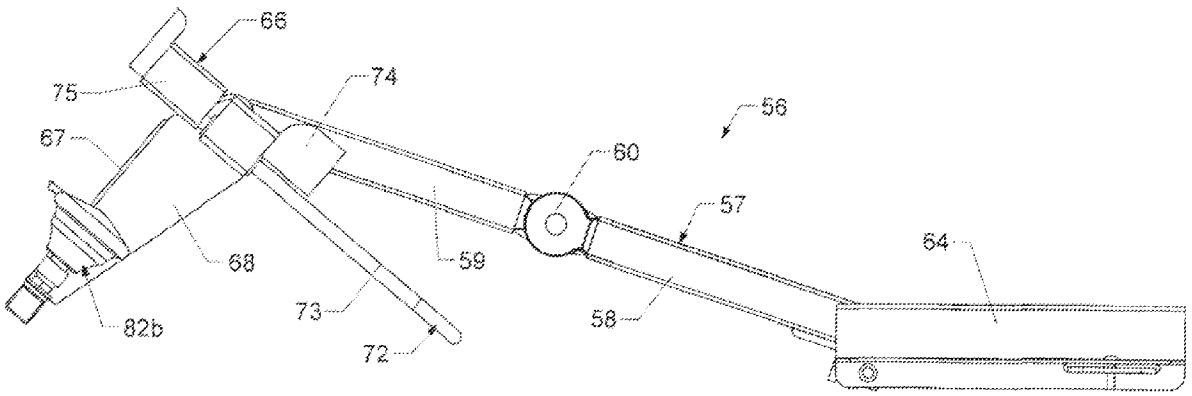
FIG. 10 is a left side view of the foot massage assembly deployed in the straight position.
Figure 12:
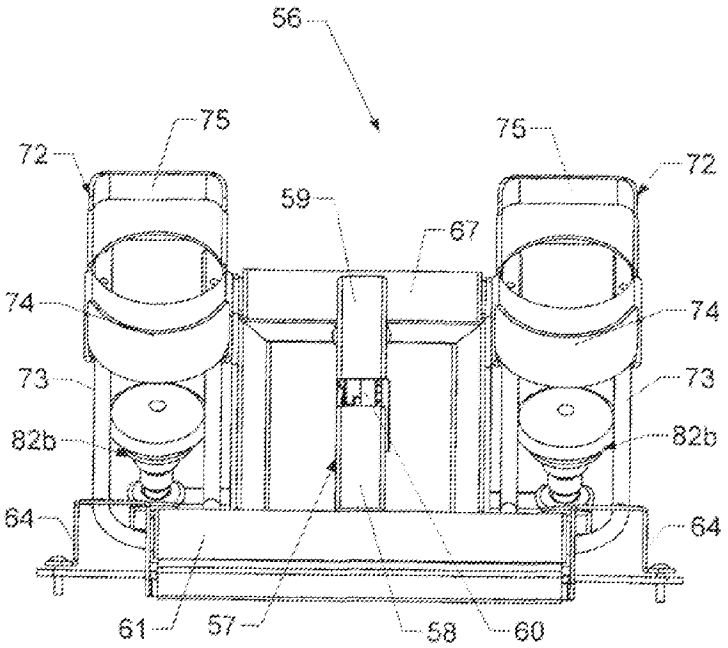
FIG. 12 is a head end view of the foot massage assembly.
Figure 11:
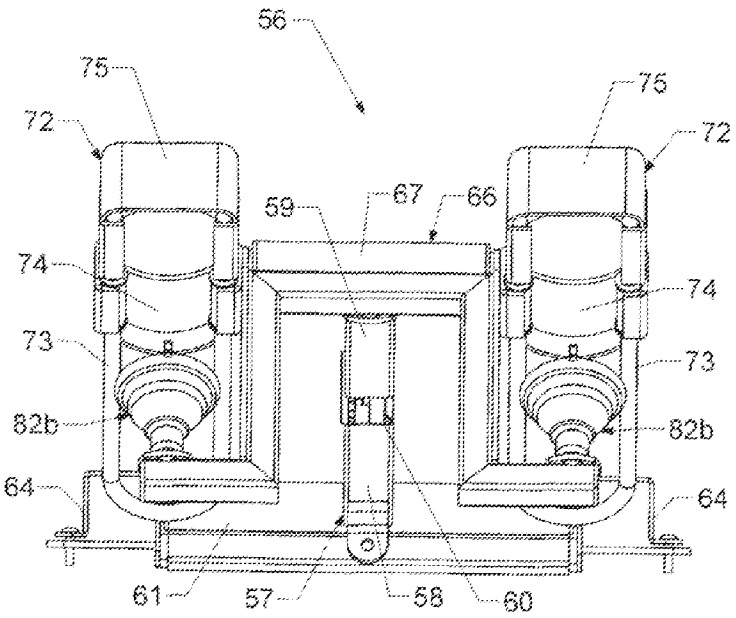
FIG. 11 is a foot end view of the foot massage assembly.
Figure 13:
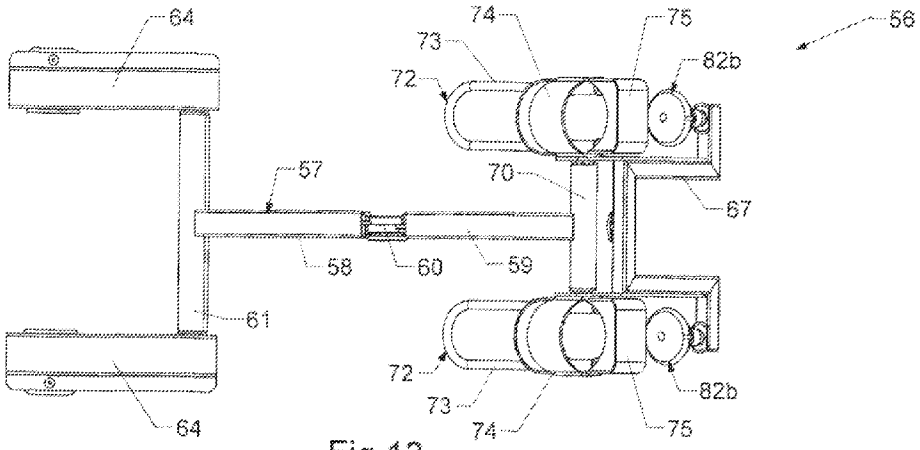
FIG. 13 is a top view of the foot massage assembly.
Figure 14:
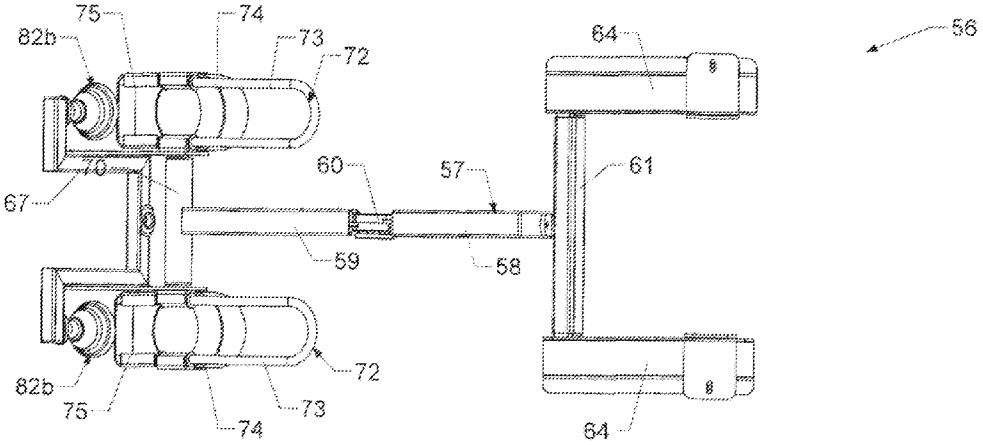
FIG. 14 is a bottom view of the foot massage assembly.
Figure 15:
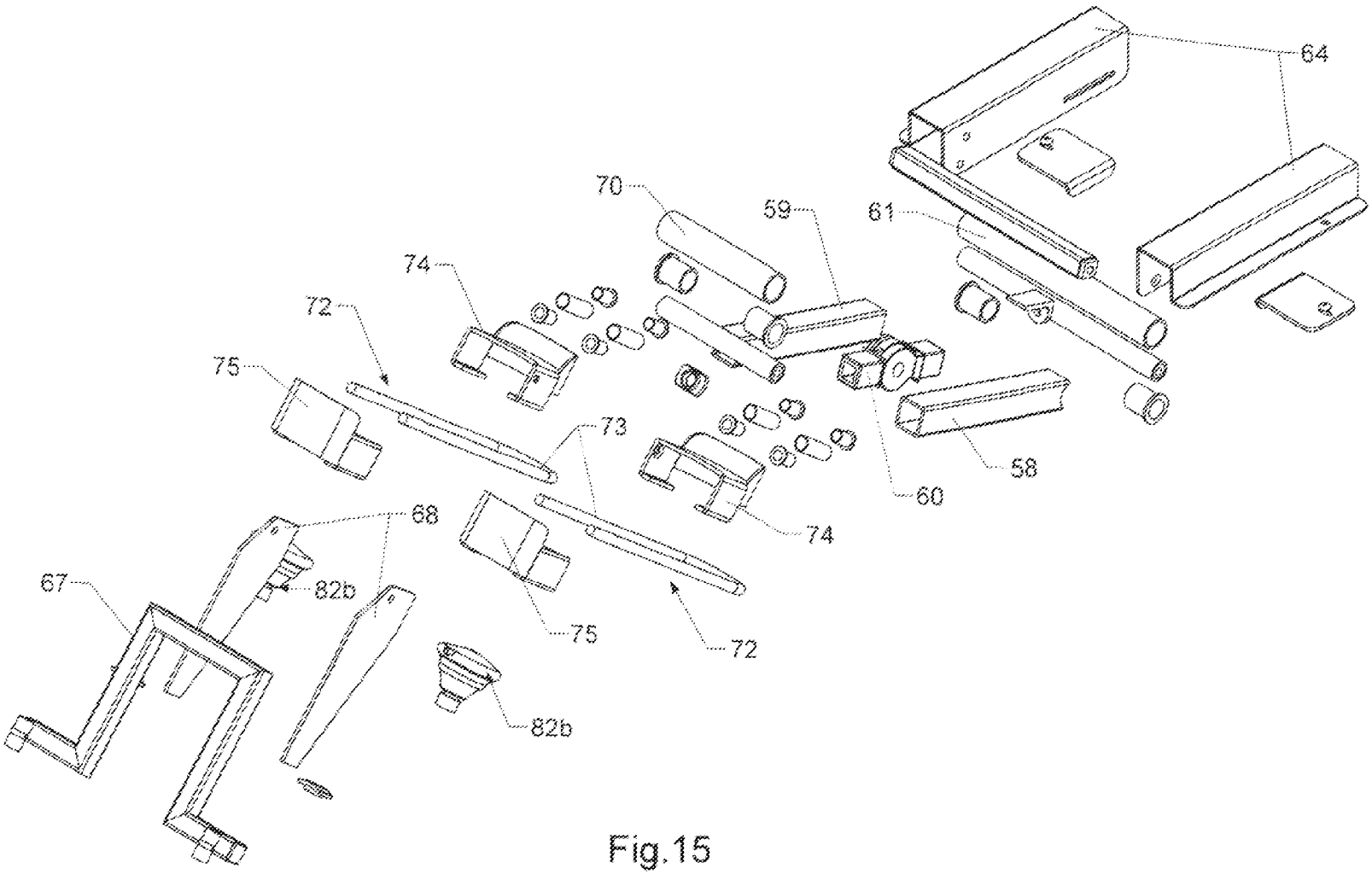
FIG. 15 is an exploded perspective view of the foot massage assembly.

The foot support 66 may further include a pair of generally elongated, parallel, spaced-apart frame support brackets 68 which are provided at the respective ends of the stirrup connector 70. A nozzle support frame 67 may be supported by the frame support brackets 68. A pair of spaced-apart foot massage nozzles 82*b* may be supported by the nozzle support frame 67. The foot massage nozzles 82*b* may be oriented toward the respective foot stirrups 72, as illustrated. The foot massage assembly 56 may be selectively deployed in an open position, as illustrated in FIGS. 5, 6 and 9-14, to facilitate water massaging of the feet of the user at an angle. Alternatively, the foot massage assembly 56 can be selectively deployed in a closed position, as illustrated in FIGS. 7 and 8, by pivoting the bracket arm 61 relative to the assembly mount brackets 64 and pivoting the distal frame arm 59 relative to the proximal frame arm 58, to facilitate water massaging of the feet of the user in a straight-up trajectory, as will be hereinafter described.

Figure 16:
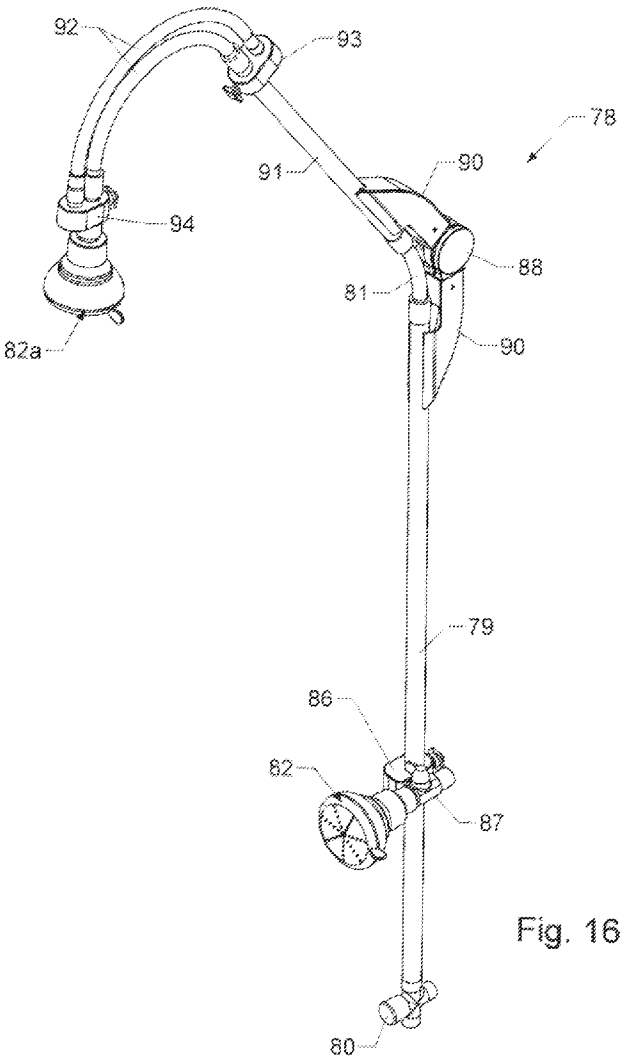
FIG. 16 is a perspective view of an exemplary shower head assembly of the multi-purpose medical shower chair.
Figure 17:
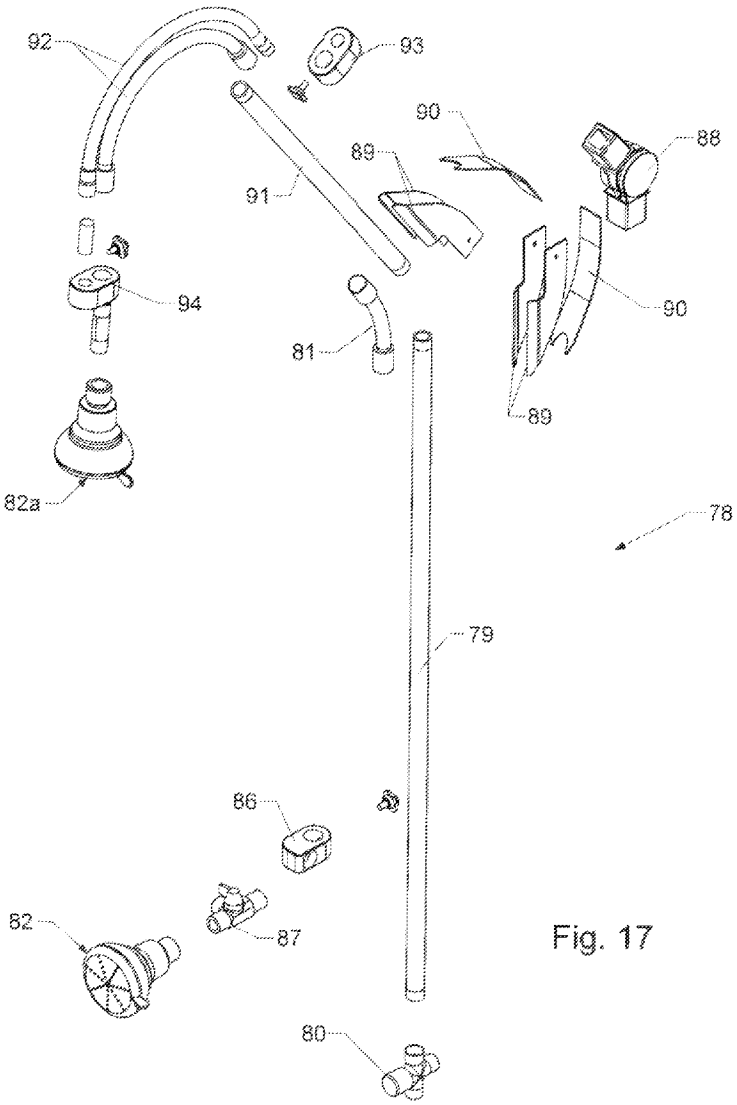
FIG. 17 is an exploded perspective view of the shower head assembly.
Figure 18:
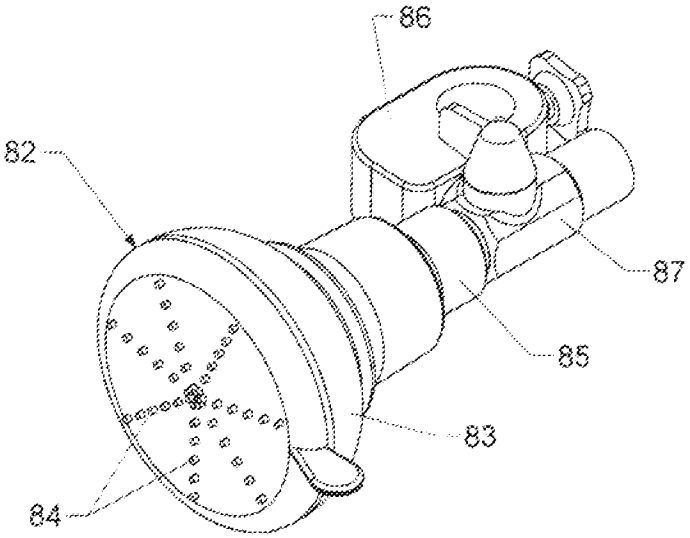
FIG. 18 is a perspective view of an exemplary shower head of the shower head assembly.

Referring again to FIG. 5 and to FIGS. 16-18 of the drawings, the chair 1 may be fitted with a shower head assembly 78 to facilitate showering of the user as the user sits in the seat 25. The shower head assembly 78 may include an elongated shower head shaft 79. As illustrated in FIG. 5, the lower end of the shower head shaft 79 may be sized and configured for insertion in the shaft collar 30 on the vertical support arm segment 22 of the seat support arm 21. A 3-position diverter valve 80 may be provided in the shower head shaft 79. A back massage nozzle 82 may be provided on the shower head shaft 79 and disposed in fluid communication therewith. A shower head positioning shaft 91 may be disposed in fluid communication with the shower head assembly shaft 79. The shower head positioning shaft 91 may be pivotally attached to the shower head assembly shaft 79 via an incremental positioning hinge 88. As illustrated in FIG. 17, the incremental positioning hinge 88 may include multiple hinge mounts 89 which are attached to the shower head assembly shaft 79 and the shower head positioning shaft 91, respectively, using mechanical fasteners and/or other technique known by those skilled in the art. Hinge mount covers 90 may enclose the hinge mounts 89. A flexible connecting conduit 81 may connect the shower head positioning shaft 91 in fluid communication with the shower head assembly shaft 79. Accordingly, the connecting conduit 81 flexes as the shower head positioning shaft 91 pivots with respect to the shower head assembly shaft 79 at the incremental positioning hinge 88.

At least one curved gooseneck conduit 92 may be disposed in fluid communication with the shower head positioning shaft 91. The gooseneck conduits 92 may be attached to the shower head positioning shaft 91 via a conduit mount bracket 93. A shower head nozzle 82*a* may be provided on the end of and disposed in fluid communication with the gooseneck conduit 92. The shower head nozzle 82*a* may be attached to the gooseneck conduit 92 via a shower head mount bracket 94.

An exemplary design for the back massage nozzle 82 and the shower head nozzle 82*a* are illustrated in FIG. 18. Accordingly, in some embodiments each nozzle 82, 82*a* may have a nozzle housing 83. Multiple nozzle openings 84 of selected size may be provided in the nozzle housing 83 in a selected pattern. A nozzle shaft 85 may be disposed in fluid communication with the nozzle housing 83. A nozzle valve 87 may communicate with the nozzle shaft 85. The nozzle valve 87 may be fitted with a nozzle switch 87*a* which facilitates selective turning of the nozzle 82, 82*a* on and off. The nozzle shaft 85 may be fitted with a nozzle clamp 86 which facilitates attachment of the nozzle 82, 82*a* to the shower head assembly shaft 79 or the gooseneck conduits 92, respectively. Accordingly, the nozzle shaft 85 of the back massage nozzle 82 is disposed in fluid communication with the shower head assembly shaft 79 and the nozzle shaft 85 of the shower head nozzle 82*a* is disposed in fluid communication with one or both of the gooseneck conduits 92. The foot massage nozzles 82*b* (FIGS. 5-15) of the foot massage assembly 56 may each have a design which is similar to that of the back massage nozzle 82 and the shower head nozzle 82*a*.

Figure 19:
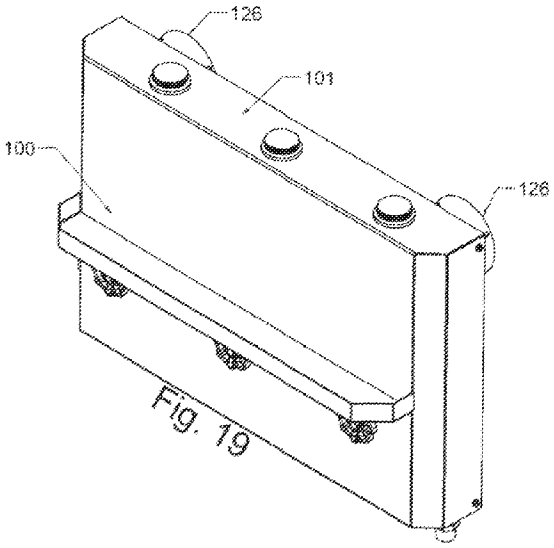
FIG. 19 is a perspective view of an exemplary shower control box of the multi-purpose medical shower chair.
Figure 20:
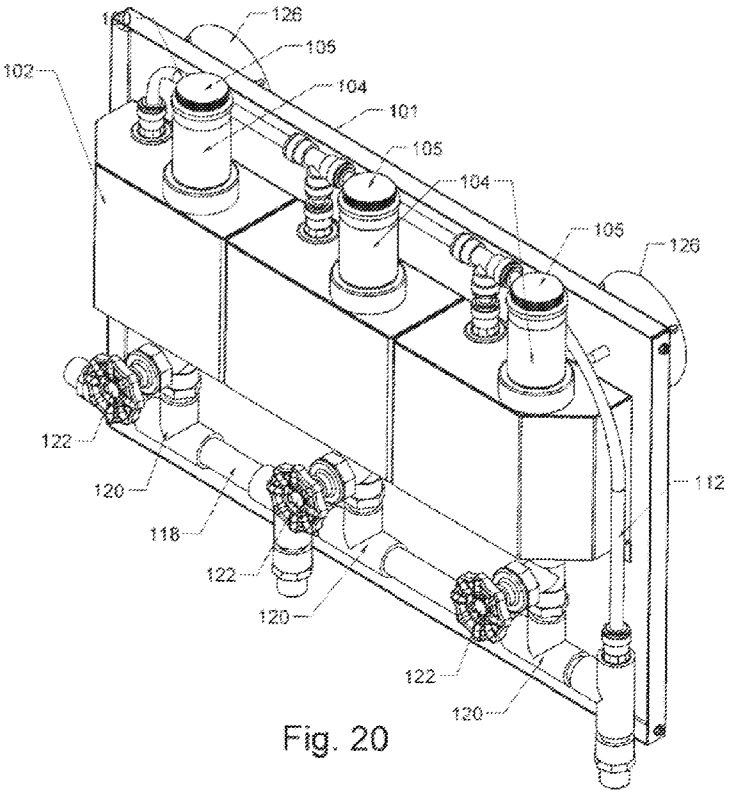
FIG. 20 is an interior view of the control box.
Figure 21:
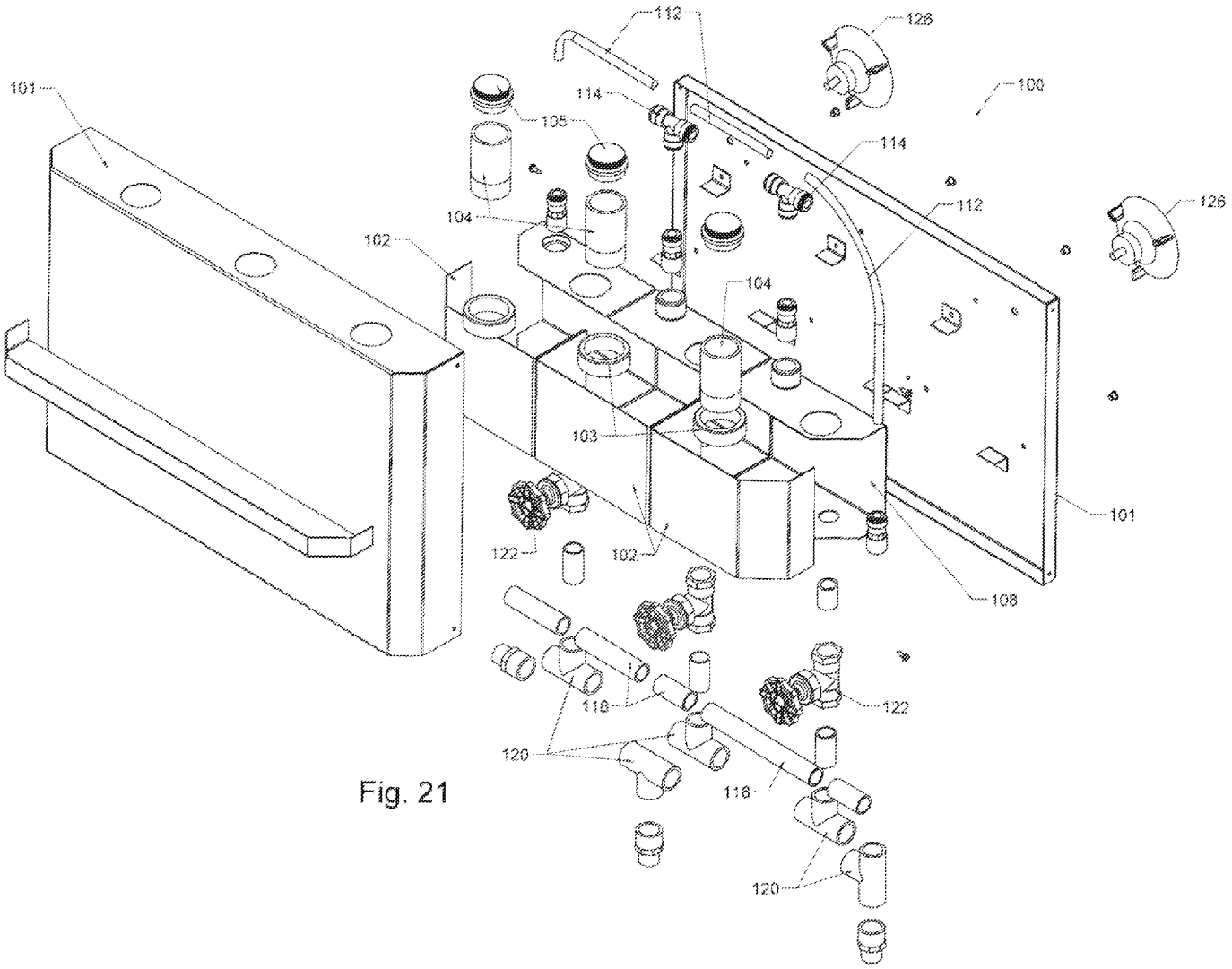
FIG. 21 is an exploded perspective view of the control box.

Referring next to FIGS. 19-21 of the drawings, an exemplary shower control box 100 which is suitable for implementation of the chair 1 is illustrated. In operation of the chair 1, which will be hereinafter described, the shower control box 100 may be used to selectively combine an additive such as a medication, shampoo, soap or the like to water and discharge a liquid mixture which includes the water and the additive from the back massage nozzle 82, the shower head nozzle 82*a*, the foot massage nozzle or nozzles 82*b* and/or the shower tube 51 of the shower tube assembly 50 (FIG. 4). As illustrated in FIG. 21, the shower control box 100 may include a control box housing 101. A box attachment mechanism such as one or more suction cups 126, for example and without limitation, may be provided on the control box housing 101 of the shower control box 100. The box attachment mechanism facilitates attachment of the control box housing 101 to a wall (not illustrated) inside a bathing or showering facility in application of the chair 1. At least one additive container 102 may be provided in the control box housing 101. In some embodiments, a container mount bracket 108 may attach the additive containers 102 to an interior surface of the control box housing 101. Each additive container 102 may have a conduit coupler 103. A liquid fill conduit 104 may be disposed in fluid communication with an inlet of each additive container 102 through the corresponding conduit coupler 103. Each liquid fill conduit 104 may be fitted with a detachable fill cap 105. Accordingly, the additive which is to be discharged from the back massage nozzle 82, the shower head nozzle 82*a* and/or the foot massage nozzle or nozzles 82*b* with water can be placed in one or more of the additive containers 102 through one or more of the liquid fill conduits 104.

A water supply conduit 112 is disposed in fluid communication with the additive containers 102 through respective water supply tees 114. The water supply conduit 112 is adapted for connection to a source of water (not illustrated) which supplies water to the back massage nozzle 82, the shower head nozzle 82*a* and the foot massage nozzles 82*b*. Multiple liquid distribution valves 122 are disposed in fluid communication with outlets (not illustrated) of the respective additive containers 102. A liquid distribution conduit 118 is disposed in fluid communication with the liquid distribution valves 122 through distribution tees 120. The liquid distribution conduit 118 is disposed in fluid communication with the shower head assembly shaft 79 (FIG. 16) of the shower head assembly 78. The liquid distribution conduit 118 may additionally be disposed in fluid communication with the foot massage nozzles 82*b* of the foot massage assembly 56 and the shower tube 51 of the shower tube assembly 50 in the seat 25 of the seat assembly 20 (FIG. 4).

Referring again to FIG. 5 of the drawings, in exemplary application, the chair 1 is placed in a bathtub, shower or other bathing or showering facility which is appropriately sized and configured to accommodate the chair 1. Accordingly, the feet 4 on the base members 3 of the chair base 2 are placed on the floor of the facility. The chair stabilizing assembly 44 may be attached to the horizontal support arm segment 24 of the seat support arm 21 and the suction cup 48 attached to the wall of the facility.

As further illustrated in FIG. 5, in some applications, the foot massage assembly 56 may be placed in front of the chair base 2 and the assembly mount brackets 64 placed over the respective base members 3 of the chair base 2. The shower head assembly 78 may be attached to the chair 1 by inserting the lower end of the shower head assembly shaft 79 into the shaft collar 30 in the assembly coupling 23 of the seat assembly 20. The shower head nozzle 82*a* may be positioned directly above the seat 25 of the seat assembly 20.

A water source (not illustrated) is connected to the shower head assembly shaft 79 to provide a source of water to the back massage nozzle 82 and the shower head nozzle 82*a*. The water source may additionally be connected to the foot massage nozzles 82*b* of the foot massage assembly 56 and the shower tube 51 in the seat 25 of the seat assembly 20.

The seat 25 of the seat assembly 20 is oriented and secured in the home position of FIGS. 1 and 5, the side position of FIGS. 2 and 3 or any position there between. A user (not illustrated), such as a physically challenged patient, sits on the seat 25 of the seat assembly 20. The user may lean back against the back rest assembly 38 and grip the handrail assemblies 38*a* to stabilize himself or herself on the seat 25. The user's feet may be placed in the foot stirrups 72 of the foot massage assembly 56. The size of each foot stirrup 72 may be adjusted to accommodate the size of the user's feet by sliding the heel support 74 relative to the toe support 75 on the stirrup frame 73.

The nozzle valve 87 on the back massage nozzle 82 (FIG. 5) can be selectively opened to discharge pressurized water from the back massage nozzle 82 against the back of the user as the user remains seated on the seat 25. The nozzle valve 87 on the shower head nozzle 82*a* can be selectively opened to discharge pressurized water over the head of the user. The nozzle valves 87 on the respective foot massage nozzles 82*b* of the foot massage assembly 56 can be selectively opened to discharge pressurized water against the bottom of the user's feet for massaging of the feet. Pressurized water can be discharged from the shower tube openings 51*a* in the shower tube 51 inside the seat 25 against the backside of the user for cleaning purposes. The water which is discharged from the back massage nozzle 82, the shower head nozzle 82*a*, the foot massage nozzles 82*b* and the shower tube 51 may drain from the patient onto the floor of the bathing or showering facility, where the water typically flows through a floor drain.

As illustrated in FIGS. 19-21, in some applications, one or more additives (not illustrated) such as shampoo, soap and/or medication or the like can be introduced into the water which is discharged from the back massage nozzle 82, the shower head nozzle 82*a*, the foot massage nozzles 82*b* and/or the shower tube 51 against the user. Accordingly, a water source (not illustrated) may be connected to the water supply conduit 112 of the shower control box 100. The liquid distribution conduit 118 of the shower control box 100 may be connected to the shower head assembly shaft 79 (FIG. 5) of the shower head assembly 78, the foot massage nozzles 82*b* of the foot massage assembly 56 and/or the shower tube 51 of the shower tube assembly 50. One or more of the additives can be placed in one or more of the additive containers 102 (FIG. 21) by removing the fill cap or caps 105 from one or more of the liquid fill conduits 104 and pouring the additive through the liquid fill conduit 104 into the additive container 102. Water from the water source (not illustrated) flows through the water supply conduit 112 and the water supply tees 114, respectively, through one or more of the additive containers 102 in the control box housing 101 of the shower control box 100. The resulting liquid mixture, which includes the additive and the water flowing through the additive container or containers 102, flows through the liquid distribution conduit 118 to the back massage nozzle 82 and the shower head nozzle 82*a* through the shower head assembly shaft 79 of the shower head assembly 78 and/or to the foot massage nozzle or nozzles 82*b* and/or the shower tube 51. The liquid distribution valves 122 on the shower control box 100 can be selectively opened or closed to control which additives are discharged from which of the additive container or containers 102 into the water flowing to the back massage nozzle 82, the shower head nozzle 82*a*, the foot massage nozzle or nozzles 82*b* and/or the shower tube 51. After use, the suction cup 48 on the chair stabilizing assembly 44 of the chair 1 may be detached from the wall of the bathing or showering facility. The foot massage assembly 56 and the shower head assembly 78 may be removed from the chair 1 and the foot massage assembly 56, the shower head assembly 78 and the chair 1 removed from the bathing or showering facility.

While the embodiments of the disclosure have been described above, it will be recognized and understood that various modifications can be made and the appended claims are intended to cover all such modifications which may fall within the spirit and scope of the disclosure.

What is claimed is:

1. A multi-purpose medical shower chair, comprising:
- a chair base;
- a seat assembly having a seat carried by the chair base;
- a shower head assembly including:
  - a shower head shaft carried by the chair base;
  - a back massage nozzle carried by the shower head shaft; and
  - a shower head nozzle carried by the shower head shaft; and
- a foot massage assembly including:
  - at least one assembly mount bracket carried by the chair base;
  - a foot massage assembly frame carried by the at least one assembly mount bracket;
  - a foot support carried by the foot massage assembly frame; and
  - a pair of foot massage nozzles carried by the foot support.

2. The multi-purpose medical shower chair of claim 1 wherein the foot massage assembly frame comprises a proximal frame arm carried by the at least one assembly mount bracket, a distal frame arm pivotally carried by the proximal frame arm, a pair of frame support brackets carried by the distal frame arm and a nozzle support frame carried by the frame support brackets, and wherein the foot massage nozzles are carried by the nozzle support frame.

3. The multi-purpose medical shower chair of claim 2 further comprising a pair of foot stirrups each including a stirrup frame carried by the foot massage assembly frame and a heel support and a toe support carried by the stirrup frame.

4. The multi-purpose medical shower chair of claim 3 wherein the heel support is adjustably carried by the stirrup frame.

5. A multi-purpose medical shower chair, comprising:

a chair base;

a seat assembly having a seat carried by the chair base; and a shower head assembly including:

a shower head shaft carried by the chair base;

a back massage nozzle carried by the shower head shaft; and a shower head nozzle carried by the shower head shaft; and a shower control box including:

a control box housing;

at least one additive container in the control box housing;

a water supply conduit disposed in fluid communication with the at least one additive container;

at least one liquid fill conduit disposed in fluid communication with the at least one additive container; and a liquid distribution conduit disposed in fluid communication with the at least one additive container and the shower head shaft; and a foot massage assembly including at least one assembly mount bracket carried by the chair base, a foot massage assembly frame carried by the at least one assembly mount bracket, a foot support carried by the foot massage assembly frame and a pair of foot massage nozzles carried by the foot support.

6. The multi-purpose medical shower chair of claim 5 wherein the foot massage assembly frame comprises a proximal frame arm carried by the at least one assembly mount bracket, a distal frame arm pivotally carried by the proximal frame arm, a pair of frame support brackets carried by the distal frame arm and a nozzle support frame carried by the frame support brackets, and wherein the foot massage nozzles are carried by the nozzle support frame.

7. The multi-purpose medical shower chair of claim 6 further comprising a pair of foot stirrups each including a stirrup frame carried by the foot massage assembly frame and a heel support and a toe support adjustably carried by the stirrup frame.

* * * * *